US010047300B2

(12) United States Patent
Sau et al.

(10) Patent No.: US 10,047,300 B2
(45) Date of Patent: Aug. 14, 2018

(54) PROCESS FOR METAL REDUCTION OF HYDROCARBON OIL

(71) Applicant: INDIAN OIL CORPORATION LTD., Kolkata, West Bengal (IN)

(72) Inventors: Madhusudan Sau, Faridabad (IN); Ganesh Vitthalrao Butley, Faridabad (IN); Yamini Gupta, Faridabad (IN); Karumanchi Ramesh, Faridabad (IN); Mainak Sarkar, Faridabad (IN); Arangarasu Arun, Faridabad (IN); Saeed Ahmed, Faridabad (IN); Brijesh Kumar, Faridabad (IN); Ravinder Kumar Malhotra, Faridabad (IN)

(73) Assignee: INDIAN OIL CORPORATION LTD., Kolkata (IN)

( * ) Notice: Subject to any disclaimer, the term of this patent is extended or adjusted under 35 U.S.C. 154(b) by 0 days.

(21) Appl. No.: 14/347,492

(22) PCT Filed: Oct. 12, 2012

(86) PCT No.: PCT/IB2012/002031

§ 371 (c)(1),
(2) Date: Mar. 26, 2014

(87) PCT Pub. No.: WO2013/054175

PCT Pub. Date: Apr. 18, 2013

(65) Prior Publication Data

US 2014/0231271 A1 Aug. 21, 2014

(30) Foreign Application Priority Data

Oct. 12, 2011 (IN) ..... 1317/KOL/2011

(51) Int. Cl.

| | |
|---|---|
| ***C10G 32/02*** | (2006.01) |
| ***C10G 21/20*** | (2006.01) |
| ***C10G 27/04*** | (2006.01) |
| ***C10G 45/22*** | (2006.01) |
| ***C10G 49/18*** | (2006.01) |

(52) U.S. Cl.

CPC ..... *C10G 32/02* (2013.01); *C10G 21/20* (2013.01); *C10G 27/04* (2013.01); *C10G 45/22* (2013.01); *C10G 49/18* (2013.01); *C10G 2300/1037* (2013.01); *C10G 2300/205* (2013.01)

(58) Field of Classification Search

CPC ..... C10G 32/02; C10G 2300/205; C10G 2300/206; B01J 19/087

USPC ..... 205/696; 208/251 R

See application file for complete search history.

(56) References Cited

U.S. PATENT DOCUMENTS

| | | | | |
|---|---|---|---|---|
| 4,676,878 | A * | 6/1987 | Chez | B01J 19/087 204/230.2 |
| 5,516,969 | A * | 5/1996 | Krasznai | G21F 9/12 208/251 R |
| 5,529,684 | A | 6/1996 | Greaney et al. | |
| 5,855,764 | A * | 1/1999 | Greaney | C10G 32/02 205/688 |
| 6,013,176 | A | 1/2000 | Greaney et al. | |
| 6,153,100 | A | 11/2000 | Mitchell | |
| 6,955,753 | B1 * | 10/2005 | Gomez | C10G 17/02 196/14.52 |
| 2012/0000792 | A1 * | 1/2012 | Greaney | C10G 32/02 205/696 |
| 2012/0125820 | A1 * | 5/2012 | Yean | C10G 27/12 208/252 |

FOREIGN PATENT DOCUMENTS

| | | | | |
|---|---|---|---|---|
| GB | 932288 A * | 7/1963 | | H01F 13/003 |
| WO | 99/03556 A1 | 1/1999 | | |

OTHER PUBLICATIONS

Wen et al, A Study of the Fe(III)/Fe(II)—Triethanolamine Complex Redox Couple for Redox Flow Battery Application, Electrochimica Acta 51 (2006) 3769-3775.*

* cited by examiner

*Primary Examiner* — Keith Hendricks
*Assistant Examiner* — Salil Jain
(74) *Attorney, Agent, or Firm* — Maschoff Brennan

(57) ABSTRACT

A novel process for metal content reduction of hydrocarbon oil is disclosed, which is primarily aimed at reduction of vanadium and nickel. The process uses electricity to accelerate the demetallation process, but only the flow of electrons of the electric current is used to expedite the reaction, instead of the electrolysis effect of the electric current. The process is carried out by adding inter-phase surface active reagent and phase transfer catalyst at a relatively low temperature range of 80 to 200° C. and achieves metal content reduction for vanadium and nickel. Aqueous phase alcoholic derivatives of amine solution is treated with hydrogen sulfide, carbon dioxide, etc. by additive reaction to render it more suitable for carrying more electric current and make them more active for metal reduction.

17 Claims, No Drawings

PROCESS FOR METAL REDUCTION OF HYDROCARBON OIL

FIELD OF THE INVENTION

The invention relates to extraction of metals from petroleum oils containing metals in general, and to a process for metal reduction of hydrocarbon oil in particular.

BACKGROUND OF THE INVENTION AND PRIOR ART

Reactive extraction of metals from petroleum oils containing metals by oxidizing and then using aqueous phase as extracting medium can be effective process for metal reduction from hydrocarbon oils. Various chemical reagents are generally employed in the aqueous phase to facilitate the reaction and subsequent extraction along with sufficient temperature and homogeneous or heterogeneous catalyst to speed up the reaction rates. The present invention discloses use of chemically modified alcoholic derivatives of amines and their judicious mixtures in such a type of process in presence of flow of electrons that significantly improves the removal of metals from petroleum oils.

Valorization of bottom of the barrel is a major challenge to refiners. Furthermore, there are various types of so-called "heavy crude oils" which are attracting attention of refiners due to price discounts. The heavy cracked fractions derived from these heavy crudes contain large quantities of metals, sulfur and nitrogen and have a low hydrogen to carbon ratio, which makes them difficult to process.

The various ways to handle this bottom of the barrel may be grouped in two categories: carbon rejection and hydrogen addition. The carbon rejection technologies include thermal and catalytic cracking, and extraction of usable fractions from resids by means of a solvent (deasphalting). The hydrogen addition route, though a costly affair, is employed due to better quality of end products. The hydrovisbreaking route is hindered by its low conversion levels and non-availability of cheaper and efficient hydrogen donor solvents. The residue up-gradation options however face difficulty due to high metals, particularly in catalytic processes as the metal content of the feedstocks are irreversible poison to the catalyst resulting in the permanent loss of its activity. So if these metals are removed prior to the processing step, then the life of the catalysts and also their regenerability increases. The metal removal also increases the value of coke in delayed coker unit.

Currently the fixed bed demetallation is employed in the refineries, which constitutes two or more hydrodemetallation reactors operating in batchwise swing mode. The catalyst is to be changed after its deactivation due to permanent nature of deactivation by metals. Solvent deasphalting process also reduces the metal content of the feedstocks by removing asphaltenes and concentrating the metals in the asphaltenes.

The amount of metals in crude oil varies from a few parts per million to more than 1000 ppm. The metals found are sodium, potassium, lithium, calcium, strontium, copper, silver, vanadium, manganese, tin, lead, cobalt, titanium, gold, chromium and nickel.

The analysis of the closest prior art shows that there are a plurality of prior art disclosures which can be considered to be quite close to the process for metal reduction of hydrocarbon oil as disclosed in the present invention.

U.S. Pat. No. 5,855,764 (Exxon Research Engineering Co) discloses a method of decreasing the metals content of metal containing petroleum streams by forming a mixture of the petroleum fraction containing those metals and an aqueous electrolysis medium containing electron transfer agent, and passing an electric current through the mixture or through the pretreated aqueous electrolysis medium at a voltage, sufficient to remove the metals such as Ni, V and iron (Fe) from the stream (i.e. to produce a petroleum fraction having decreased content of the metals).

U.S. Pat. No. 5,529,684 (Exxon Research Engineering Co) discloses a process for demetallation where the feed, to be demetallized can have a range of vanadium and/or nickel content.

U.S. Pat. No. 6,013,176 (Exxon Research Engineering Co) provides a method for demetallization and ultimately the demetallation (particularly of metal species typically associated with hydrocarbon species and thus hydrocarbon soluble, e.g., petroporphyrins) of the metal-containing hydrocarbonaceous petroleum stream by contacting with a base, an oxygen-containing gas and at least one phase transfer agent at an effective temperature of from 100° C. to 180° C. to produce a treated petroleum stream. The oxygen containing gas is air or an effective concentration of oxygen and air mixture to produce enhanced extractability and ultimately demetallation under process conditions.

Use of electrical energy is prevalent in the prior art. Electricity used in all prior art documents considered close to the present invention was however found to be by way of electrolysis.

However, the present invention discloses a process which is unique because though it deploys electrical energy, the electricity does not result in electrolysis of the medium. The electricity used in the present invention is for providing electrons only as a new and unconventional way which enhances the process of metal reduction. The present invention also provides the means to carry the current through reaction medium in enhanced quantities by modifying the chemicals.

OBJECTS OF THE INVENTION

An object of the present invention is to provide a speedy process to reduce the metal content in the heavy petroleum fractions.

Another object of the invention is to remove the metal for the petroleum feed prior to processing so as to increase the life of the catalysts as well as their regenerability.

SUMMARY OF THE INVENTION

The present invention discloses a new way of decreasing the metal concentration from different petroleum fractions including heavy crude oils, heavy fraction derived from heavy crude oils and short residue (vacuum residue). The metal-containing petroleum fraction is contacted with an aqueous solution containing chemically modified organic alcoholic derivatives of amines or mixtures thereof in presence of organic or inorganic peroxides, oxygen containing gas (similar to air) and phase transfer catalyst at reaction temperature under pressure. Use of chemically modified alcoholic derivatives of amines or mixtures thereof significantly improves the rate of metal reduction in the process as compared to the use of conventional strong or weak alkalis or amines without any chemical modification.

The reaction can be further increased by employing external sources of energy such as microwaves, electromagnetic waves such as infrared, visible, UV, etc., ultrasound waves or electric current. The present invention discloses the use of electric energy for energizing the molecules in a novel and innovative way. Both AC and DC or even electricity having other wave forms can be used for this purpose. The present invention discloses the use of electric energy only, and not the use of electrochemical or electrolysis properties of the chemicals used in the process for the metal reduction.

The present invention removes all types of metal impurities from different petroleum fractions including oil soluble metal moieties such as vanadium and nickel present in the form of different porphyrins.

DETAILED DESCRIPTION OF THE INVENTION

The invention will now be described in an exemplary embodiment which is non-limiting. There can be other embodiments of the same invention, all of which are deemed to have been covered by this description.

The present invention discloses a process for metal reduction of hydrocarbon oils. The hydrocarbon oil consists of organic metal compounds like petroporphyrins or it may consist of inorganic metal compounds. Hydrocarbon oil can be heavier fractions (550° C.+) or heavy crude oils containing metal concentrations 1 ppm to several thousand ppm.

The present invention provides a method for removing all types of metal species, particularly vanadium and nickel present in the form of porphyrins, from different petroleum fractions including heavy crude oil.

The petroleum fraction is contacted with an aqueous solution of organic amines or their alcoholic derivatives in presence of organic and inorganic peroxide, oxygen containing gas (like air) and inter-phase surface-active reagents and phase transfer catalyst at a temperature kept preferably between 20 to 400° C., and more preferably between 80 to 200° C., which is sufficient for proper mixing of the two phases, and at pressure between 5-30 barg which is just sufficient for maintaining both the phases in liquid form. The time of reaction is 1 to 20 hours, more preferably 5 to 15 hours, still most preferably 8 to 12 hours. The temperature, pressure and other conditions that are required to complete the reaction within reasonable time are maintained.

To accelerate the rate of reaction, an electric current (either DC or AC having any wave form) is passed through the reaction medium. Other external energy sources like ultrasound, electromagnetic waves such as infrared, visible, UV, microwaves, can also be deployed.

The reactor system used in the present invention is a typical semi-batch or continuous type reactor with heating and cooling arrangement. The reactor assembly is also equipped with agitator and baffle arrangement as known in the art for ensuring intimate contact between two immiscible liquid phases, of which one is petroleum oil and other is aqueous phase containing various chemical reagents. Gas sparger is provided for passing oxygen containing gas through the reaction medium and pressure controlling arrangements are incorporated. One of the additional features of the reactor system is the arrangement for passing electric current (AC or DC) through the reaction medium even at high pressure. The current flow is provided by two similar metal plates immersed in the intimately mixed two-liquid phase mixture.

Among all types of metallic species present in the crude oil V and Ni are the most difficult to remove and these are present in oil-soluble organometallic complex form, generally known as porphyrins. The concentrations of above two metallic species are increasing day by day as the crudes are becoming heavier. Vanadium and Nickel are present in all petroleum fractions but the concentration increases in the heavy petroleum fractions such as Vacuum Gas Oil (VGO) and vacuum residue. These two metallic species require particular attention since these are the permanent catalyst poisons in the secondary processes such as Fluidized Catalytic Cracking (FCC) and Hydrocracking. The removal of metal content also improves the quality and hence the market price of the coke in delayed coker unit. The present invention has particularly targeted V and Ni since these two metals cannot be removed by any cost-effective demetallation technique presently available. As the present invention is capable of removing the most difficult metallic species, the process in accordance with the present invention can be used for removing other metallic species too.

The petroleum fractions being used as feed may contain any type of metals of any concentration. Typically the vanadium and nickel content in the petroleum fractions varies from 10 to 2000 ppm and 2 to 500 ppm respectively. However, any concentration of such metals can be treated by the process described by the present invention.

The aqueous alcoholic derivatives of amine solution can be prepared by mixing any type of alcoholic derivatives of amines or their other types of salts known in the art with demineralised (DM) water. The amines can be primary, secondary or tertiary amines and they are the alcoholic derivatives of amines like ethanolamine, diethanolamine, methyl diethanolamine, etc. Normally the conductivity of the alcoholic derivatives of amine solutions are very low but in the present invention, an unique technique of doping with $H_2S$, halides, oxides of carbon, oxides of sulfur, etc. has been followed for increasing the conductivity of the alcoholic derivatives of amine solutions. In the present invention methyl di-ethanol amine (MDEA) has been used since it is very common in the refineries. The concentration of chemically modified alcoholic derivatives of amines in water can be 1 wt % up to saturation levels at the reaction temperatures. The water employed should be free of all contaminants down to ppb levels before using.

According to the present invention, a continuous bubble column type reactor with heating and cooling arrangement is used where aqueous solution of alcoholic derivatives of amines can be fed either in a batch mode or in continuous mode. The chemical reagent such as $H_2S$, halides, oxides of carbon, oxides of sulfur, etc. with which it is to be reacted in additive type of reaction is passed through or mixed intimately (if Continuous Stirred Tank Reactor (CSTR) is used) for a pre-determined time for the reaction to be completed. The reaction time required for this doping of $H_2S$, halides, oxides of carbon, oxides of sulfur, etc. in alcoholic derivative of amines is in the order of minutes. The product thus obtained is used in the present invention.

The alcoholic derivatives of amines are treated/loaded with hydrogen sulfide, carbon dioxide, etc. up to various levels concentrations so as to have different currents at different concentrations. These derivatives of amine solution is treated with hydrogen sulfide, carbon dioxide, etc. by additive reaction to render it more suitable for carrying more electric current and make them more active for metal reduction.

Peroxide used in the present invention can be of any type, i.e. organic or inorganic, solid or liquid. Peroxide has been used as a source of nascent oxygen. Any other source of nascent oxygen can be also used instead of peroxide.

The oxygen containing gas may be of any type having suitable oxygen concentration. The oxygen containing gas mentioned in the invention has dual purpose of maintaining pressure and at the same time creating the oxidizing environment inside the reactor. The percentage of oxygen in oxygen containing gas can vary from 1 to 100 vol %. If the percentage of oxygen in the gas to be used is less than 100%, the inert component of the gas is to be chosen from any gas which does not take part in the present reaction and at the same time is environmentally safe. Most preferred choice is nitrogen.

The inter-phase surface-active reagents are required for intimate contacting of the phases and also for their efficient separation after the contacting. Such chemicals can be called as emulsifiers, demulsifiers, antifoaming reagents, etc. The selections of these chemicals are well known in the art. These chemicals get themselves aligned on the phase boundaries of the phases involved to perform their intended functions. The quantities of these chemicals required may vary depending on the type of phases and other chemicals in those phases, temperature and pressure conditions, and extent of mixing, etc.

The Phase Transfer Catalyst (PTC) used for the process may be selected by the skill known in the art. The PTC may be miscible or immiscible with the petroleum stream to be treated. The phase transfer catalyst facilitates transferring materials across the phase boundaries i.e. oil and aqueous phase. The amount of PTC required for 1 g of feed (i.e. metal-containing petroleum stream) may vary from 0.01 to 1 g.

The inter-phase surface active reagent and phase transfer catalyst are quaternary ammonium salts or any other chemical reagent having one polar end and other non-polar end in each molecule.

The metal-containing petroleum fractions (feed for the process) should be essentially in the liquid state in the process conditions. In case of petroleum fractions that are solids at ambient temperature such as vacuum residue the temperature of the process should be above the melting point of the feed. This is essential for proper mixing of the two phases so that mass transfer across the phase is enhanced. Further, for intimate contacting, these should be finely dispersed in the form of micro-sized droplets in the aqueous phase by the skills known in the art.

The stirrer speed should be so maintained that the proper mixing of the two phases is achieved. The optimum stirrer speed will vary depending upon the reactor dimension. The speed of the stirrer for the particular reactor used for the present invention is 600 RPM. Other means such as special baffles may also be employed for obtaining the required intimate mixing.

The electric current (Alternating Current (AC) or Direct Current (DC)) can be also passed through the reaction medium to accelerate the demetallation process. The amount of current passing through the reaction medium may vary depending upon the potential difference across the electrodes and the conductivity of the reaction medium. The typical current density may vary between 0-1000 mA/cm$^2$. The electrical energy can be employed for speeding up the reaction rate in different types of ways. For example, in desalters, a static form of electrostatic force is used to energize and in turn convert the water droplets into dipoles. It can be used in the form of flow of electron or ions. Conventionally, two electrodes are involved having different potentials which facilitate the flow of electrons from one electrode to the other. Out of these two electrodes, conventionally, one is standard reference electrode and the other has a relative positive or negative overpotential. This invention uses an innovative way of introducing electric current irrespective of the overpotentials and standard reference electrodes. No reference electrodes are used in the present invention.

According to the present invention, only the flow of electrons is used to expedite the reaction, instead of the electrolysis effect of the electric current. The electrodes employed are of same metal for both the electrodes to complete the circuit through the liquids surrounding the electrodes in which they are dipped. In this way, it is ensured that these electrodes are not taking part in the reaction in any way.

The conductivity of petroleum fractions is low. The dielectric constant for the petroleum fractions are typically in the range of 1.5 to 2.0. The conductivity of the reaction medium, therefore, entirely depends upon the conductivity of the aqueous medium. Purified water is again a bad conductor of electricity and so are the amines and alcoholic derivatives of amines. Therefore, to pass electricity through the reaction medium, either any electrolytic salt can be used or the alcoholic derivatives of amines can be doped with some chemicals such as $H_2S$, oxides of carbon and sulfur, halides, etc to make chemicals achieve enhanced reaction capability. The doping of these chemicals may be done as explained above. These chemicals can be sourced from any known source. For example, $H_2S$ can be sourced from $H_2S$ bearing gases like hydroprocessing (hydrotreating/hydrocracking) off gases through the alcoholic derivatives of amine solution or by adding $H_2S$ generating compounds like di methyl disulphide (DMDS) and heating up to its decomposition temperature. The $CO_2$, $SO_2$, $SO_3$ or other oxides of carbon and sulfur can be sourced from any known source for passing it under conditions such that it should undergo additive reaction with alcoholic derivatives of amine solution.

After cooling, aqueous phase is separated and oil phase, i.e. the treated petroleum fraction, is washed three to four times with DM water at 80-100° C. three times and then dried and analyzed for metal content.

The aqueous phase containing various reagents is recycled or not recycled depending on the need.

The amount of DM water required may vary from 50 ml to 1000 ml for 100 g feed. The washed product is dried before analysis for metal content. The product obtained after the said treatment contains less metal than the feed streams. The extent of metal reduction can vary in the range of 10 to 100 wt % for vanadium and nickel.

EXAMPLES

Experiment-1

100 gms of vacuum residue was taken in a one liter batch reactor and subsequently 500 ml of 10 vol % methyl di-ethanol amine (MDEA), 10 g benzoyl peroxide and 5 g of tetra butyl ammonium hydroxide (TBAH) were added to it. The reactor was then pressurized to 25 barg pressure with air. Air was purged into the reaction mixture at a rate of 2 standard liters per hour (SLPH) with the help of a mass flow controller. The pressure in the reactor was maintained at 25 barg with a backpressure regulator. The reaction mixture was then heated to 100° C. with an electrically heated furnace. To homogenize the reaction mixture, the stirrer speed was maintained at 600 RPM. When the temperature of the reaction mixture reached 100° C., the entire condition was maintained for 10 hours. The reactor was then cooled to ambient temperature and the reaction mass taken out from the reactor after depressurization. The reaction mass was then cleaned with 1000 ml distilled water.

While the feed resid contained 172 ppm vanadium and 46 ppm nickel, the product resid was found to contain 156 ppm vanadium (reduction of 9.3%) and 43 ppm nickel (reduction of 6.5%) as determined by Inductively Coupled Plasma (ICP) analysis.

Experiment-2

One hundred grams of vacuum residue was taken in a one liter batch reactor and subsequently 500 ml of 10 vol % methyl di-ethanol amine (MDEA), 10 gm benzoyl peroxide and 5 g of tetra butyl ammonium hydroxide (TBAH) were added to it. The reactor was then pressurized to 25 barg pressure with air. Air was purged into the reaction mixture at a rate of 2 standard liters per hour (SLPH) with the help of a mass flow controller. The pressure in the reactor was maintained at 25 barg with a backpressure regulator. The reaction mixture was then heated to 100° C. with an electrically heated furnace. To homogenize the reaction mixture, the stirrer speed was maintained at 600 RPM. To expedite the reaction rate, an electric current of 0.13 to 0.5 A (DC) was passed through the reaction mixture with the help of 5 volt electrodes arrangement provided outside the reactor system. The current through the reaction mixture was varied using a rheostat arrangement. The maximum current achieved with 5 volt electrodes arrangement was 0.5 A (DC). The entire condition was maintained for 10 hours after the temperature of the reaction mixture reached 100° C. The reactor was then cooled to ambient temperature and the reaction mass taken out from the reactor after depressurization. The reaction mass was then cleaned with 1000 ml distilled water.

While the feed resid contained 172 ppm vanadium and 46 ppm nickel, the product resid was found to contain 153 ppm vanadium (reduction of 11.04%) and 43 ppm nickel (reduction of 6.52%), as determined by Inductively Coupled Plasma (ICP) analysis.

Experiment-3

The same procedure as in experiment-2 was followed; but pure 10 vol % aqueous solution of MDEA was replaced by $H_2S$ doped 500 ml 10 vol % MDEA. Because of $H_2S$ doping, the conductivity of the reaction medium, increased and the maximum current went up to 4 A (DC) with the same 5 volt electrodes arrangement. Therefore there was an increase of 800% in the current due to doping. Vanadium and nickel content in the product and feed resid were analyzed by inductively coupled plasma (ICP) method. Vanadium and nickel content in product resid was found to be 123 (reduction of 28.48%) and 38 ppm (reduction of 17.39%) respectively whereas in feed resid the same was found to be 172 and 46 ppm.

Experiment-4

The same procedure as in experiment-3 was followed; however instead of 4 A, 1 A DC was passed through the reaction mixture. Vanadium and nickel content in product resid was found to be 126 (reduction of 26.74%) and 37 ppm (reduction of 19.56%) respectively for the same initial values for the feed resid.

Experiment-5

The same procedure as in experiment-4 was followed; but instead of 1 A DC, 1 A AC was passed through the reaction mixture. Vanadium content in product resid was found to be 132 (reduction of 23.25%) for the same initial values for the feed resid.

We claim:

1. A process for metal reduction of hydrocarbon oil comprising:

a) contacting hydrocarbon oil with an electrolytically conductive aqueous solution, a source of oxygen, an inter-phase surface active reagent and phase transfer catalyst to get a reaction mixture;

b) stirring the reaction mixture at predetermined pressure of 5-30 barg & temperature conditions of 20 to 400° C.;

c) passing an electric current through the reaction mixture for sufficient time to generate hydrocarbon oil with reduced metal contents; and d) washing the reaction mixture with water and then drying the reaction mixture;

wherein the reaction is expedited through flow of electrons of the electric current and the electrolytically conductive solution used is alcoholic derivatives of amines which are chemically modified by doping with a doping agent to accelerate the reaction;

wherein the doping agent used for doping the alcoholic derivatives of amines is a chemical selected from the group consisting of halides, oxides of carbon, hydrides, oxides of sulphur, and hydrogen sulphide.

2. The process as claimed in claim 1, wherein said amines are primary, secondary or tertiary amines selected from the group consisting of ethanolamine, diethanolamine, and methyl diethanol amine (MDEA).

3. The process as claimed in claim 1, wherein said doping has been done through a chemical selected from the group consisting of hydrogen sulphide, and carbon dioxide.

4. The process as claimed in claim 1, wherein the source of oxygen is selected from the group consisting of air, oxygen, ozone, and peroxide.

5. The process as claimed in claim 1, wherein said inter-phase surface active reagent and phase transfer catalyst are quaternary ammonium salts or any other chemical reagent having one polar end and other non-polar end in each molecule wherein said chemical reagent is an onium salt.

6. The process as claimed in claim 5, wherein the onium salt is tetra butyl ammonium hydroxide (TBAH).

7. The process as claimed in claim 1, wherein there is an 800% increase in the current due to doping of the alcoholic derivatives of amines with $H_2S$.

8. The process as claimed in claim 1, wherein the electric current can either be DC or AC having any wave form.

9. The process as claimed in claim 1, wherein the electric current has a density in the range of 0 to 1000 $mA/cm_2$.

10. The process as claimed in claim 1, wherein the alcoholic derivatives of amines are chemically modified through the doping agent in a continuous bubble column type reactor with heating and cooling arrangement, where aqueous solution of the alcoholic derivatives of amines can be fed either in a batch mode or in continuous mode.

11. The process as claimed in claim 1, wherein the metal reduction is in the range of up to 40% for vanadium and up to 30% for nickel.

12. The process as claimed in claim 1, wherein the metal reduction depends upon the amount and type of electric current wherein the type of the electric current is selected from DC or AC.

13. The process as claimed in claim 1, wherein the current flow is provided by two plates made of the same metal immersed in intimately mixed two-liquid phase mixture.

14. The process as claimed in claim 1, wherein the alcoholic derivatives of amines are chemically modified by treating with the doping agent of various concentration levels so as to have different currents at different concentrations of chemically modified alcoholic derivatives of amines.

15. The process as claimed in claim 1, wherein concentration of the chemically modified alcoholic derivatives of amines in water is between 1 wt % and saturation level concentration at the reaction temperatures.

16. The process as claimed in claim 1, wherein predetermined time of reaction is 1 to 20 hours.

17. The process as claimed in claim 1, wherein whole aqueous phase containing various reagents is recycled to step (a) to contact with the hydrocarbon oil.

* * * * *